US006899033B2

(12) United States Patent
Marietta

(10) Patent No.: US 6,899,033 B2
(45) Date of Patent: May 31, 2005

(54) FIRECRACKER PACKAGING

(75) Inventor: Michael S. Marietta, Pittsburg, KS (US)

(73) Assignee: Jake's Fireworks, Inc., Pittsburg, KS (US)

( * ) Notice: Subject to any disclaimer, the term of this patent is extended or adjusted under 35 U.S.C. 154(b) by 0 days.

(21) Appl. No.: 10/424,433

(22) Filed: Apr. 28, 2003

(65) Prior Publication Data

US 2004/0211334 A1 Oct. 28, 2004

(51) Int. Cl.[7] ..... F42B 4/04; F42B 3/00
(52) U.S. Cl. ..... 102/361; 86/20.1; 86/21
(58) Field of Search ..... 102/361, 356, 102/357; 86/20.1, 21, 22

(56) References Cited

U.S. PATENT DOCUMENTS

| | | | | | |
|---|---|---|---|---|---|
| 634,177 | A | * | 10/1899 | Lispenard | 102/361 |
| 639,605 | A | * | 12/1899 | Nordlinger | 102/361 |
| 645,135 | A | * | 3/1900 | Scalona | 102/356 |
| 645,688 | A | * | 3/1900 | Lispenard | 102/361 |
| 651,068 | A | * | 6/1900 | Curtis | 102/361 |
| 774,779 | A | | 11/1904 | Ranz | |
| 956,546 | A | | 5/1910 | Schulman | |
| 1,002,744 | A | * | 9/1911 | Nordlinger | 102/361 |
| 1,441,552 | A | * | 1/1923 | Adler | 102/361 |
| 1,563,379 | A | | 12/1925 | Kohn | |
| 1,610,645 | A | | 12/1926 | Adler | |
| 1,727,705 | A | * | 9/1929 | Hitt | 102/361 |
| 1,755,003 | A | | 4/1930 | Hitt | |
| 1,761,820 | A | * | 6/1930 | Fabrizio | 102/357 |
| 1,770,921 | A | | 7/1930 | Hitt | |
| 1,824,367 | A | * | 9/1931 | Priestley | 102/361 |
| 1,861,893 | A | | 6/1932 | Yamagishi | |
| 1,886,407 | A | | 11/1932 | Kohn | |
| 1,972,478 | A | | 9/1934 | Fabrizio | |
| 2,142,227 | A | | 1/1939 | Whiteside | |
| 3,206,015 | A | | 9/1965 | Zimmer et al. | |
| 3,227,084 | A | | 1/1966 | Stokes et al. | |
| 3,744,417 | A | * | 7/1973 | Kaneko | 102/361 |
| 3,917,441 | A | | 11/1975 | Gray | |
| 4,495,868 | A | | 1/1985 | Matthews | |
| D279,280 | S | | 6/1985 | Resnick | |
| 5,343,808 | A | | 9/1994 | Collar | |
| D351,786 | S | | 10/1994 | Grunhut | |
| 5,429,053 | A | | 7/1995 | Walker | |
| 5,585,591 | A | | 12/1996 | Waldock | |
| D397,459 | S | | 8/1998 | Hsu | |
| D402,321 | S | | 12/1998 | Kirk | |
| 5,996,777 | A | | 12/1999 | Capers, III | |
| D437,648 | S | | 2/2001 | Pappas | |
| 6,283,033 | B1 | | 9/2001 | Wu et al. | |
| 6,470,803 | B1 | | 10/2002 | Liu et al. | |
| 6,499,405 | B1 | | 12/2002 | Ambrico | |

OTHER PUBLICATIONS

Jake's Fireworks Printed Catalog; Published Apr. 30, 1999.
Jake's Fireworks Printed Internet Catalog: Published 2003.

* cited by examiner

*Primary Examiner*—Michael J. Carone
*Assistant Examiner*—Lulit Semunegus
(74) *Attorney, Agent, or Firm*—Hovey Williams LLP

(57) ABSTRACT

A firecracker packaging is provided which enables both carrying a single ignition detonation of a large number of firecrackers in an attractive package resembling a giant firecracker. At least one and preferably a plurality of spiral-wound strings of firecrackers having interconnected fuses are stacked together in a substantially cylindrical stack, covered by wrapping, and a handle extends from one end of the wrapping. The handle is preferably a length of line. Binding is positioned between the strings and the wrapping to retain the cylindrical configuration of the strings. Connecting fuses between adjacent strings permit ignition of the woven individual firecracker fuses in one string to lead to ignition of the woven individual firecracker fuses of the adjacent string.

18 Claims, 3 Drawing Sheets

FIRECRACKER PACKAGING

BACKGROUND OF THE INVENTION

1. Field of the Invention

The present invention concerns firecracker packaging which is especially attractive and advantageously permits common packaging of a large number of firecrackers in a single unit. More particularly, the packaging of firecrackers in accordance with the present invention permits interconnection of multiple spiral-wrapped rolls of firecrackers both from a carrying and detonation stanpoint whereby multiple rolls of firecrackers may be readily carried to destination and then either separated for individual detonation or ignition from a single fuse.

2. Description of the Prior Art

Firecrackers are ancient in origin and have long been used in a variety of celebrations. As is well known, firecrackers include a small amount of gunpowder constituting a charge centrally contained within a paper wrapping and having a fuse which leads to the charge. Also, as is well known, firecrackers are most commonly interconnected to one another in a common group or, as used herein, a string of firecrackers whereby individual firecrackers are placed in alternating opposition in a lay-flat orientation with their individual fuses interconnected by weaving. Such strings are also commonly wrapped in paper and bear a manufacturers label. In this way, it is possible to detonate the entire string by lighting the fuse of one firecracker at the end of the string. Because the fuses are woven along a central ignition passageway, the first fuse also ignites the second, which connects to the third, and so on. As the fuses burn toward their respective charges, each fuse ignites another and then separates from the string before or at detonation, whereby all or substantially all of the firecrackers in the string ignite and detonate. The rapid and repeated detonations have long been regarded as entertaining. However, the weaving of the fuses also permits individual firecrackers to be separated and detonated individually, as desired by the user.

While it is thus known to have a string of firecrackers packaged as a group in serpentine or even rolled configurations, some purchasers may desire to have especially long strings of firecrackers. As the strings grow longer, the challenge of packaging and transport becomes more difficult. Long strings of firecrackers tend to become unwieldy and difficult to hold. It may be appreciated that as strings exceed 1000 firecrackers, the string may become difficult to manage. Moreover, such especially long strings of packaging present little in the way of marketing attraction to hold the eye of the consumer.

There has thus developed a need for an improved firecracker packaging which is economical, as firecrackers are intended as inexpensive amusement items, but also solves these problems.

SUMMARY OF THE INVENTION

The foregoing problems have in large measure been resolved by the firecracker packaging of the present invention. The firecracker packaging hereof is especially decorative and exciting to the eye of the consumer, and provides significant improvement in the ability to transport and retain large numbers of firecrackers. Moreover, the packaging hereof permits common packaging and operational interconnection of multiple strings of firecrackers whereby the user may light only one fuse to detonate thousands and thousands of firecrackers. In the preferred embodiment, the packaging presents an especially novel, ornamental and eye-catching appearance for packaging a plurality of firecrackers whereby the spiral-wound strings are superposed one atop another, connected together and surrounded by a wrapper, and the handle extends from the top of the packaging so as to present the appearance of a single, giant firecracker.

Broadly speaking, the fireworks packaging of the present invention includes a plurality of spiral wrapped strings of firecrackers, wrapping for surrounding and protecting the strings, a binder for holding the strings in position internally within the wrapper, and a handle extending from the interior of the wrapping externally thereof. The strings are operatively coupled one to another by at least one connecting fuse which extends from the woven individual firecracker fuses of one string to the woven individual firecracker fuses of an adjacent string of firecrackers. Preferably, a plurality of connecting fuses extend from one string to an adjacent string to provide for the contingency that anyone of the connecting fuses may be extinguished, disconnected or otherwise fail to complete the ignition of the next string. The strings are not only operatively coupled but also connected by the binder which preferably aids in maintaining the stability of each of the strings both individually and as a group in the packaging. The binder may be provided as strap, adhesive, net, or other retaining member, but the use of a plurality of straps has proven to be economical to use, provides good stability, and minimizes extra weight and problems with disposal. The wrapper is preferably a coated paper or a plurality of paper layers which surrounds the bound strings of firecrackers, and serves not only to provide a limited amount of protection against damage such as impact and moisture intrusion, but also permits a decorative appearance for the packaging. The handle is preferably a length of nylon, sisal or hemp line of suitable length and thickness to provide the appearance of an especially large fuse. The handle also includes an attachment member within the wrapping for holding the line to the bound strings, such as a core presenting a central passage. The core may be fastened, adhered, or simply frictionally fit snugly against at least one of the bound strings, and the line may be knotted at the bottom to engage the core, and/or fused, adhered by adhesive, or mechanically fastened to the core. Thus, when the user pulls up on the portion of the line extending from the wrapping, the force is transmitted to the strings connected by the binding, and the entire packaging is lifted.

Beneficially, at least one of the spiral-wound strings of firecrackers includes a fuse which is readily accessible by peeling away a part of the wrapping without disconnecting the binding. The connecting fuses may be surrounded by paper to help prevent moisture intrusion, and may be positioned so as to avoid placement around the exterior of the strings. The strings may be bound, such as by circumferentially extending straps, to provide additional stability. Also, supporting disks, such as of paperboard or corrugated paper, may be placed above the topmost string and below the bottommost string to provide additional strength and support and to protect the strings against damage by the binding.

In use, the user may carry large numbers of firecrackers by the handle without substantial stress. For example, the packaging hereof may contain 16,000 firecrackers and weigh about 60 pounds, but the user may simply grasp the line extending from the wrapping for easy transport of short distances. The user then peels back the wrapping. If it is desired, the strings may be separated, and then the paper opened to obtain access to individual firecrackers or the string cut along the woven fuses into short string lengths.

Alternatively, the firecrackers may remain operatively interconnected with the strings either laid out flat or bound, and when the initial fuse is lit, ignition should continue along each string leading the ignition process to detonate substantially all of the firecrackers in the package.

DESCRIPTION OF THE PREFERRED EMBODIMENT

Figure 1:
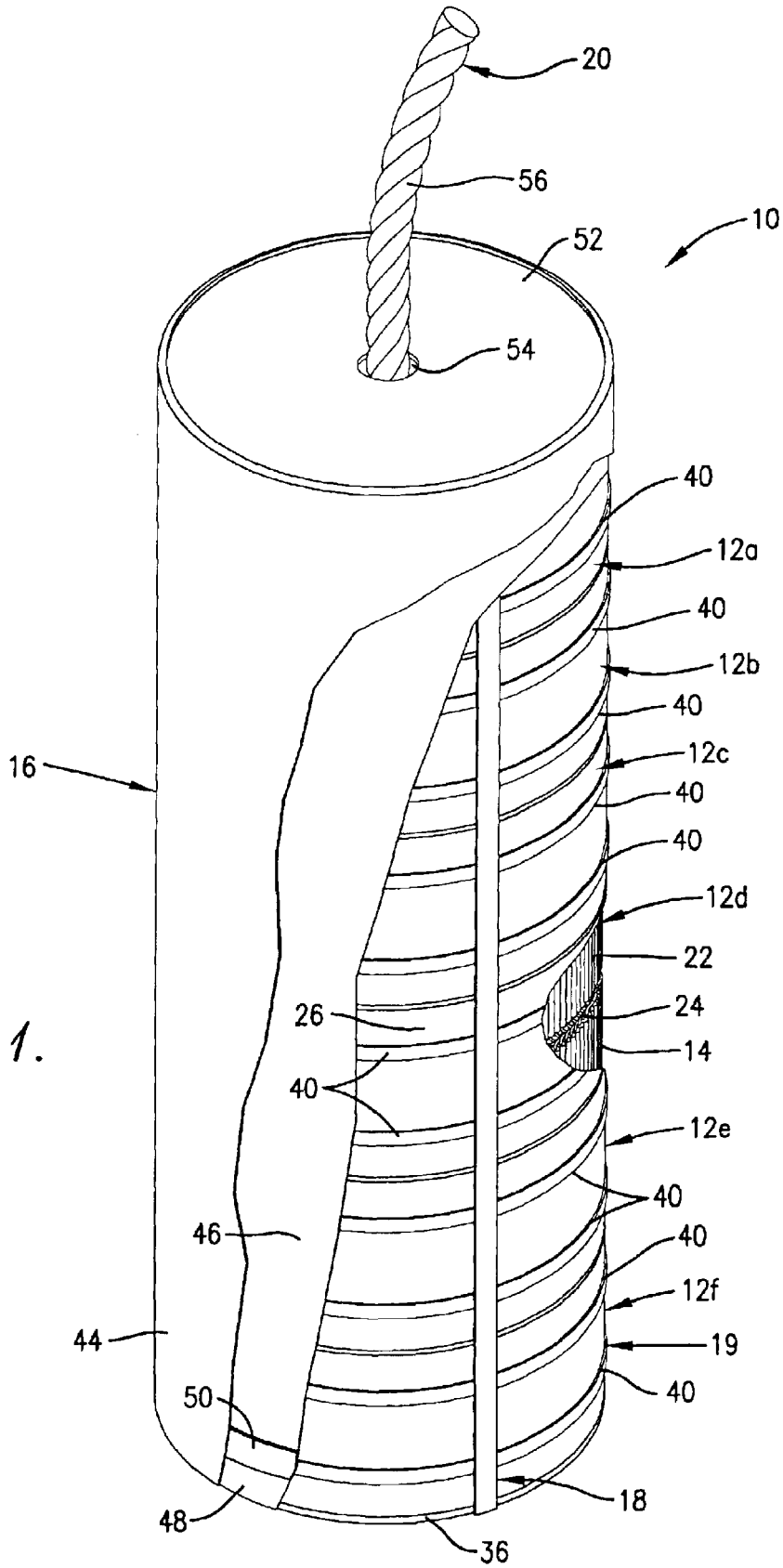
FIG. 1 is a perspective view of the firecracker packaging hereof, with portions of the wrapping broken away to reveal the binding and the strings, and portions of the paper around a string broken away to show the individual firecrackers and fuses in the string.

Referring now to the drawing, a firecracker packaging 10 as shown in FIG. 1 broadly includes a plurality of strings 12 of firecrackers 14, preferably in spiral-wound orientation, wrapping 16 substantially enclosing the strings 12, binding 18 interconnecting the strings 12 into substantially rigid stack 19, and a handle 20 extending from the top of the wrapping 16 and connected to at least one of strings 12 in the stack 19.

Figure 2:
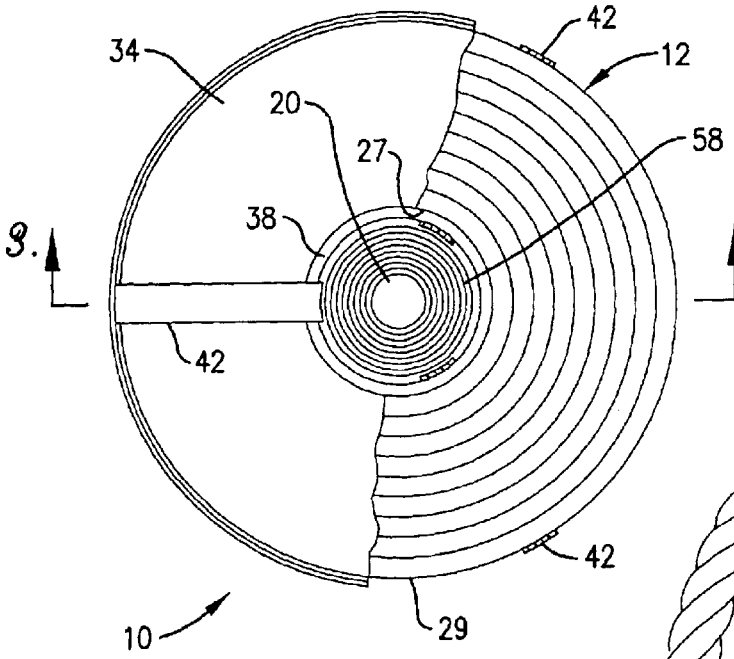
FIG. 2 is a top plan view of the firecracker packaging hereof with the top wrapping removed for clarity to show the binding, and a portion of the top disc broken away to show the topmost spiral wound string of firecrackers.

In greater detail, each firecracker 14 includes a body 22 and an individual fuse 24, the body including a gunpowder charge contained within a covering of paper or the like whereby upon ignition of the fuse, the charge is detonated after a short time lag. The individual fuses 24 are woven or otherwise interconnected to permit separation while also permitting substantially sequential ignition as is well known. A thin paper cover 26 substantially surrounds the string 12. In the preferred embodiment hereof, each string 12 is spirally wrapped with a radially inner surface 27 disposed around a cylindrical cardboard collar 28 and connected thereto either by friction as a result of tightness of the wrapping process or by adhesive, and a radially outer surface 29. Each string 12 is thus substantially cylindrical in configuration as shown by FIGS. 1 and 2 and has a central space 31 radially interior to the inner surface 27 into which the collar 28 is received.

Figure 3:
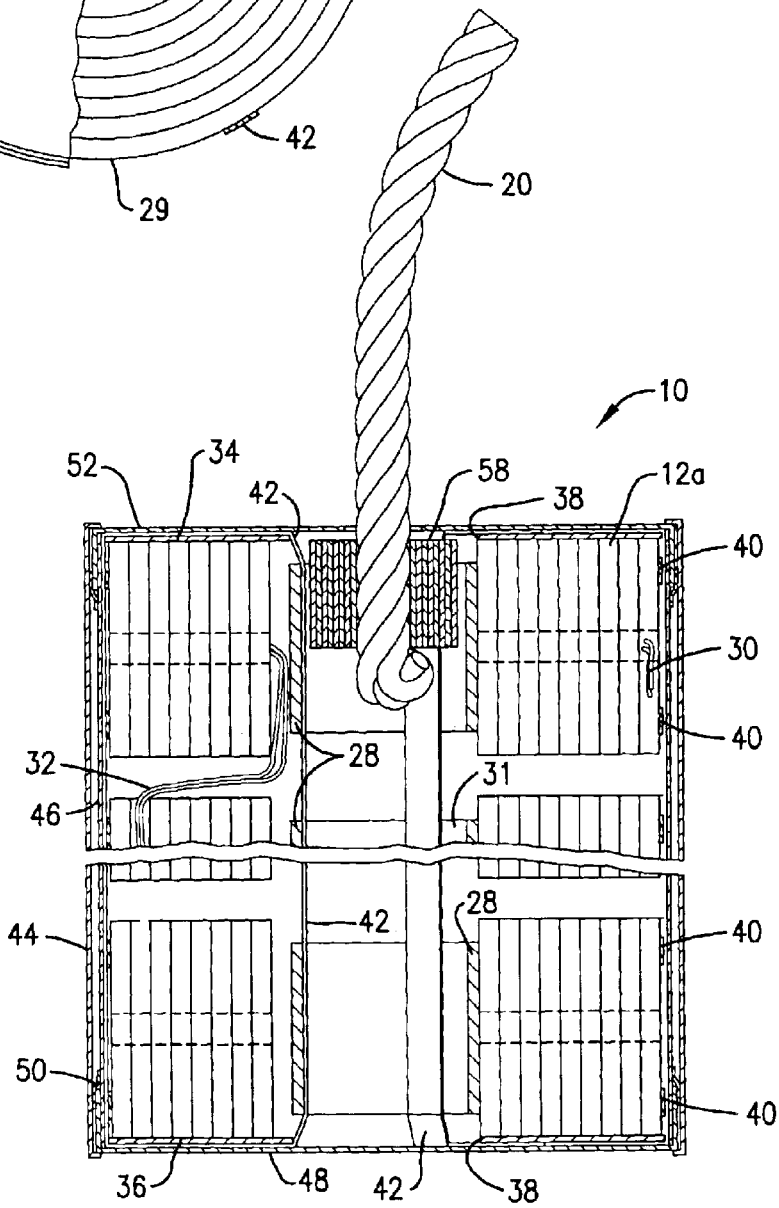
FIG. 3 is a fragmentary vertical cross-sectional view taken along line 3—3 of FIG. 2 showing the topmost and bottommost strings of firecrackers with intermediate strings broken away.
Figure 4:
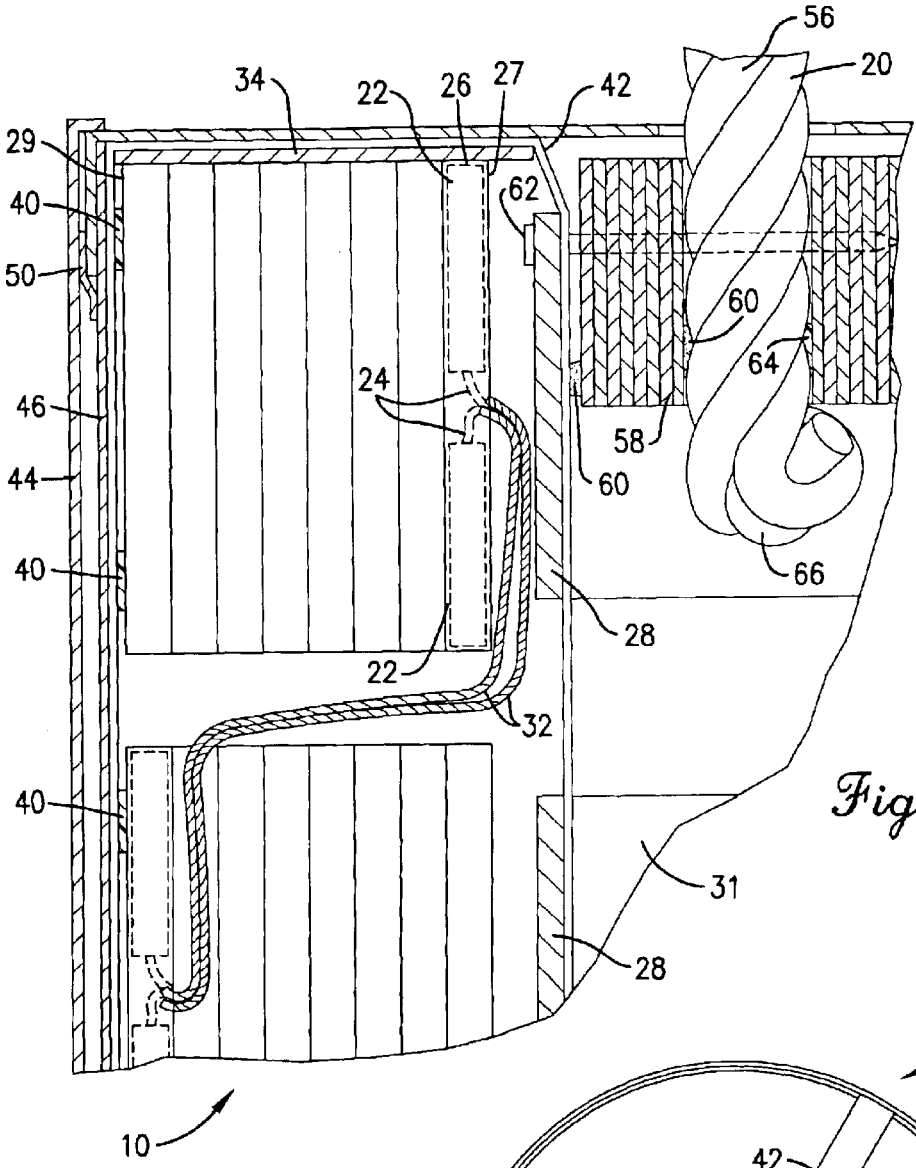
FIG. 4 is an enlarged fragmentary vertical cross sectional view similar to FIG. 3 but with exaggerated spacing for clarity showing the handle and the connecting fuses in greater detail.
Figure 5:
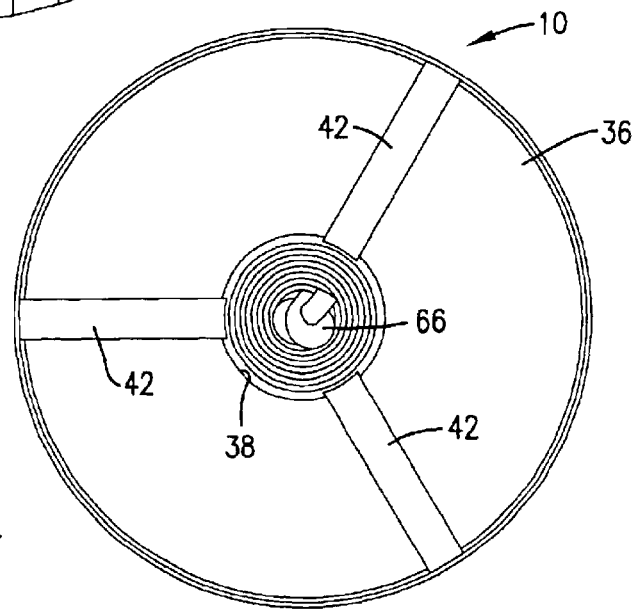
FIG. 5 is a bottom view of the fireworks packaging hereof with the bottom wrapping removed to show the positioning of the binding around the bottom disc.

In normal, upright orientation with the handle 20 positioned uppermost, the strings 12 are vertically stacked in superposed relationship one atop another. As depicted in FIG. 1, six strings 12*a,* 12*b,* 12*c,* 12*d,* 12*e,* and 12*f* are illustrated, although it is to be understood that even a single string 12 could be used in the packaging hereof and theoretically the number of strings which could be stacked is limited only by the carrying capacity of the consumer and/or the strength of the binding material and connection of the handle to the strings. As shown in FIG. 3, an initial ignition fuse 30 is provided on the outer surface 29 of one of the strings 12, preferably topmost string 12*a*. The initial ignition fuse 30 leads directly to the woven individual fuses 24 of that string 12*a* whereby the detonation of all of the firecrackers 14 in the string 12*a* may be initiated. The woven individual fuses in each string 12 then wind inwardly along the spiral path, ending with the last firecrackers 14 in the string 12. From the inward end of each of the strings 12, at least one, and preferably a plurality of connection fuses 32 lead to the woven individual fuses 24 of the next lowermost string 12. Thus, in the stack 19 illustrated in FIG. 1, connection fuses 32 lead from string 12*a* to 12*b,* as shown in FIGS. 3 and 4, and connection fuses 32 also lead from string 12*b* to string 12*c,* string 12*c* string 12*d,* string 12*d* to string 12*e,* and string 12*e* to string 12*f.*

An upper disc 34 is placed on top of the uppermost string 12 and a lower disc 36 is placed below the bottommost string 12 in order to protect against damage by binding 18. The discs 34 and 36 are preferably inexpensive and combustible, each being preferably made of paperboard or corrugated paper, and each having a central opening 38. Thus, discs 34 and 36 are positioned at the top and the bottom of the stack 19.

Binding 18 is most preferably of string, twine, synthetic resin such as nylon strips or other elongated flexible material which may be secured at the ends thereof by fasteners or by tying. Binding 18 most preferably includes circumferential bands 40 which are wrapped around the outside of each string 12 to maintain the spiral-wound integrity of each string 12, even when separated. In addition, binding 18 includes stack bands 42 which connect the strings 12 within the stack 19. As illustrated in the preferred embodiment, the stack bands 42 extend over the top of the upper disc 32, down through the central opening 38 over the collars 28 and through the central space 31, underneath the lower disc 36, and outside the outer surface 29 of the strings 12 and over the circumferential bands 40 and remaining inside the wrapping 16 to complete a loop. Preferably, a plurality of stack bands 42 are provided improved stability and integrity of the stack 19.

Wrapping 16 extends outside the stack 19 and preferably includes a circumferentially extending outer wall 44 of coated paper to bear color and/or indicia thereon, a circumferentially extending inner wall 46 of paperboard or the like beneath the outer wall 44, a bottom panel 48 which is circular when viewed from the bottom but extends upwardly over the inner wall 46 and secured thereto by adhesive tape 50, and beneath the outer wall 44. A top panel 52 has a central opening 54 and extends over the upper disc 34 and may be secured to the inner wall 46 by adhesive tape 50.

Handle 20 includes a line 56 of nylon, or alternatively of sisal, hemp or other flexible material, and a central tubular core 58. The central tubular core 58 has a central opening through which the line 56 passes, and may be provided of solid material such as wood, or as illustrated, laminated paper in wrapped, built-up condition. The central tubular core 58 may be frictionally fitted against the collar 28 of the uppermost string 12*a,* and/or connected thereto by adhesive 60 and a mechanical fastener such as a nail 62. The nail 62 may extend through the central tubular core 58 into the line 56 and adhesive 60 may also used between the core 58 and the line 56. Where the line is of a synthetic resin such as nylon line, a portion of the line 56 adjacent the core 58 may be melted to fuse the line 56 to the core 58 as shown in FIG. 4 by melt 64. In addition, the line 56 may be tied into a knot 66 which provides interference between the line 56 and the bottom of the core 58. The line extends upwardly through the openings in the upper disk 34 and the top panel 52 a sufficient distance to permit grasping by the user.

In use, the firecracker packaging 10 provides a convenient transportable carrier for a large number of firecrackers. The user may peel away the wrapping 16 and cut the stack bands 42 to gain access to the individual strings 12 which are functionally separated by also cutting the connecting fuses. The user may then cut away the circumferential bands 40 around each string 12 to lay the firecrackers flat or separate the firecrackers 14. If desired, the strings 12 may be removed but remain connected by the connecting fuses 32, and then upon ignition of the initial ignition fuse 30, substantially all of the firecrackers may be detonated. Finally, though not recommended, it is theoretically possible to leave the strings 12 connected by the stack bands and the circumferential bands, and by lighting the initial ignition fuse 30, substanially all of the firecrackers 14 may be detonated while in the stack 19.

Although preferred forms of the invention have been described above, it is to be recognized that such disclosure is by way of illustration only, and should not be utilized in a limiting sense in interpreting the scope of the present invention. Obvious modifications to the exemplary embodiments, as hereinabove set forth, could be readily made by those skilled in the art without departing from the spirit of the present invention.

The inventor hereby states his intent to rely on the Doctrine of Equivalents to determine and assess the reasonably fair scope of his invention as pertains to any apparatus not materially departing from but outside the literal scope of the invention as set out in the following claims.

What is claimed is:

1. A firecracker packaging comprising:

at least one string including a plurality of firecrackers having individual fuses which are ignitably interconnected, said at least one string having a substantially cylindrical configuration;

wrapping positioned exteriorly of the at least one string and having an opening therethrough; and a handle separate from said fuses operatively connected to the at least one string and extending through said opening in the wrapping and exteriorly thereof for enabling the carrying of the packaging by said handle.

2. A firecracker packaging as set forth in claim 1, including binding extending circumferentially around the string for retaining the string in a substantially cylindrical configuration.

3. A firecracker packaging as set forth in claim 2, wherein said binding extending circumferentially around the string is positioned intermediate the string and the wrapping.

4. A firecracker packaging as set forth in claim 1, including a plurality of said strings positioned in superposed, adjacent relationship and comprising a stack.

5. A firecracker packaging as set forth in claim 4, including at least one connecting fuse positioned interiorly of said wrapping operatively connecting adjacent strings within said stack whereby the interconnected individual firecracker fuses in one string may ignite the at least one connecting fuse for igniting the interconnected individual fuses of the firecrackers in the second string.

6. A firecracker packaging as set forth in claim 5, said strings including an outer surface, and including an initial ignition fuse extending from the outer surface of at least one of said strings.

7. A firecracker packaging as set forth in claim 4, including binding positioned interiorly of said wrapping and connecting said plurality of strings.

8. A firecracker packaging as set forth in claim 7, wherein said plurality of strings are spirally wrapped and have a central space radially interior to an inner surface of the string and a radially outer surface, and wherein said binding includes at least one stack band of flexible material extending through a central space of each of said adjacent strings and extending around the outer surface of each of said adjacent strings to bind the adjacent strings in superposed relationship within the stack.

9. A firecracker packaging as set forth in claim 8, said binding further including at least one circumscribing band of flexible material extending around the outer surface of at least one of said strings in said stack.

10. A firecracker packaging as set forth in claim 7, wherein said handle is operatively connected to an uppermost one of said strings in said stack when said stack is in an upright orientation, and whereby lifting of said handle lifts said stack.

11. A firecracker packaging as set forth in claim 4, wherein said uppermost string includes a core presenting an opening for the passage of said handle therethrough.

12. A firecracker packaging as set forth in claim 11, wherein said handle is connected to said core by a mechanical fastener.

13. A firecracker packaging as set forth in claim 11, wherein said handle is connected to said core by adhesive.

14. A firecracker packaging as set forth in claim 11, wherein said handle includes an enlarged portion for abutting engagement with said core.

15. A firecracker packaging as set forth in claim 11, wherein said handle is fused to said core.

16. A firecracker packaging as set forth in claim 1, wherein said handle is a flexible line.

17. A firecracker packaging as set forth in claim 1, including a plurality of said strings positioned in superposed relationship, binding coupling said plurality of strings into a substantially cylindrical stack of strings, adjacent strings in said stack being operatively connected by connecting fuses, said wrapping substantially covering said strings and said binding to present a cylindrical appearance having first and second ends, and said handle including a line of flexible material extending from one of said first and second ends.

18. A firecracker packaging as set forth in claim 17, said stack including an uppermost string and a lowermost string, and including a first disc positioned between an upper side of said uppermost string and said binding and a second disc positioned between a lower side of said upper most string and said binding, said discs being positioned interiorly of said wrapping.

* * * * *